US007040935B2

(12) United States Patent
Wei

(10) Patent No.: US 7,040,935 B2
(45) Date of Patent: May 9, 2006

(54) ELASTIC TERMINAL

(75) Inventor: Shih-Fu Wei, Chung Ho (TW)

(73) Assignee: Jess-Link Products Co., Ltd., Taipei (TW)

( * ) Notice: Subject to any disclaimer, the term of this patent is extended or adjusted under 35 U.S.C. 154(b) by 0 days.

(21) Appl. No.: 10/959,039

(22) Filed: Oct. 7, 2004

(65) Prior Publication Data

US 2006/0079136 A1 Apr. 13, 2006

(51) Int. Cl.
*H01R 13/24* (2006.01)

(52) U.S. Cl. ..... 439/700

(58) Field of Classification Search ..... 439/700, 439/824, 754, 862, 65–67, 357–358
See application file for complete search history.

(56) References Cited

U.S. PATENT DOCUMENTS 5,304,753 A * 4/1994 Parrish et al. ..... 200/16 B
5,713,765 A * 2/1998 Nugent ..... 439/700
6,524,140 B1 * 2/2003 Takagi et al. ..... 439/700
6,855,010 B1 * 2/2005 Yen ..... 439/700

* cited by examiner

*Primary Examiner*—J. F. Duverne
(74) *Attorney, Agent, or Firm*—Rosenberg, Klein & Lee

(57) ABSTRACT

An elastic terminal provides multi-directional reacting forces for ensuring the contact reliability and uses a cheaper Cu alloy to reduce production costs. The elastic terminal is received in an electrical connector, and has a retaining portion, an elastic arm, and a contact portion. The retaining portion has a soldering leg extending downwardly and vertically therefrom, which is connected electrically to a cable. The elastic arm has a longwise curved portion which extends upwardly from one side of the retaining portion, and at least two transverse curved portions which are formed on one side of the longwise curved portion. The contact portion is formed on an end of the elastic arm and is exposed outside the slot of the electrical connector.

18 Claims, 4 Drawing Sheets

ELASTIC TERMINAL

BACKGROUND OF THE INVENTION

1. Field of the Invention

The present invention relates to an elastic terminal which is assembled in an electrical connector for electrically connecting to a terminal of a mating electrical connector, particularly to an elastic terminal having elasticity and being retractable.

2. Description of the Prior Art

Please refer to FIG. 1, a perspective view of an electrical connector and a mating electrical connector of prior art. Such kinds of electrical connectors are plug-type electrical connectors which are used with, for example, a mobile phone, a PDA, or a recharge seat etc. The electrical connector 8 has an insulative housing 82, a plurality of elastic terminals 84, and a cable 83. The elastic terminals 84 are received in the insulative housing 83 and exposed outside the top portion of the insulative housing 82. The cable 83 is connected to an end of the electrical connector 8. The electrical connector 8 is mated with a mating electrical connect 9, and the mating electrical connector 9 has a plurality of flat terminals which are fixed on the bottom thereof.

Please refer to FIG. 2, a front view of an elastic terminal of prior art. To ensure the contact stability and reliability between the connectors, the elastic terminals 84 are designed to contact with the flat terminals 92 of the mating electrical connect 9 elastically. The elastic terminal 84 has a retaining portion 85, an elastic arm 86, and a contact portion 87. The retaining portion 85 interferes with the inner walls of the insulative housing 82. The elastic arm 86 extends upwardly and bends to the left side and the right side, so that it contacts elastically with the flat terminals 92 of the mating electrical connector 9.

However, the flat terminals 92 react to the elastic terminals 13 not only in a vertical direction but also in an oblique direction, when the electrical connector 8 is connecting with the mating electrical connector 9. Moreover, the electrical connector 8 hangs down due to the cavity, causing the elastic terminals 84 to contact obliquely with the flat terminals 92 of the mating electrical connector 9. But the elastical arm 86 of prior art only provides a strong longitudinal resilience. Weak resilience in the other direction fatigues the elastical arm 86. In terms of structure, the electrical connector 8 must provide a longer longitudinal cavity for receiving the elastic terminals 84 result in a larger volume.

When the contact portion 87 is pushed with oblique force, the top portion of the elastic arm 86 becomes deformed. The prior art adds thickness to the top portion of the elastic arm 86 and is formed with a bottom portion 88. But this structure reduces elasticity and increases costs.

Because the elastic arm 86 only resists longitudinal deformation, the stress thereon is concentrated and stronger. To strengthen the elastic arm 86, the elastic terminals 84 are usually made of materials with high intensity, for example, Be—Cu alloy. Although Be—Cu alloy improves hardness and intensity, it is very expensive and costs are higher when it is used. Furthermore, as the elastic arm 86 is repeatedly bent it becomes longer resulting in a larger impedance and affecting the quality of transmission.

Therefore, the elastic terminal of the prior art still has some disadvantages to be overcome. The inventor, after investigation and research, thus provides the present invention of logical design for improving the above-mentioned imperfections.

SUMMARY OF THE INVENTION

An objective of the present invention is to provide an elastic terminal that is assembled in an electrical connector for connecting electrically to a mating connector; particularly an electrical connector having elasticity and which is retractable.

In order to achieve the above objects, the elastic terminal, which is received in an electrical connector for connecting electrically with a mating connector, comprises a retaining portion, an elastic arm, and a contact portion. The retaining portion has a soldering leg extending downwardly and vertically therefrom. The elastic arm has a longwise curved portion which extends upwardly from one side of the retaining portion, and at least two transverse curved portions which are formed on one side of the longwise curved portion. The contact portion is formed on an end of the elastic arm and exposed outside the slot of the electrical connector.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
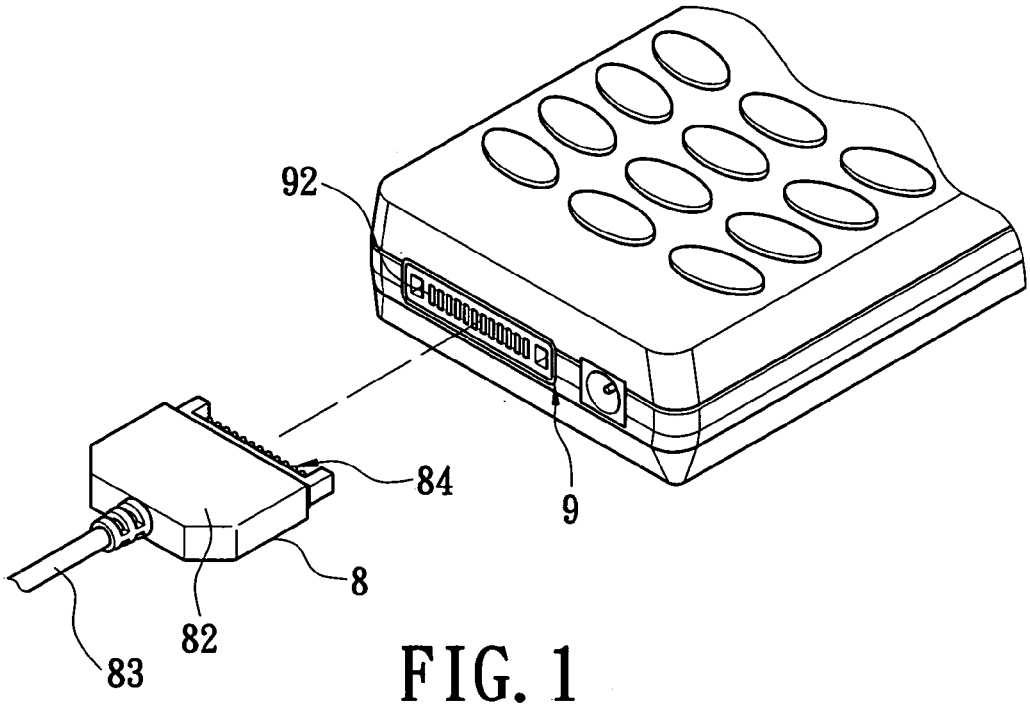
FIG. 1 PRIOR ART
FIG. 1 is a top view of an unfolded electrical-current biosensor of prior art.
Figure 2:
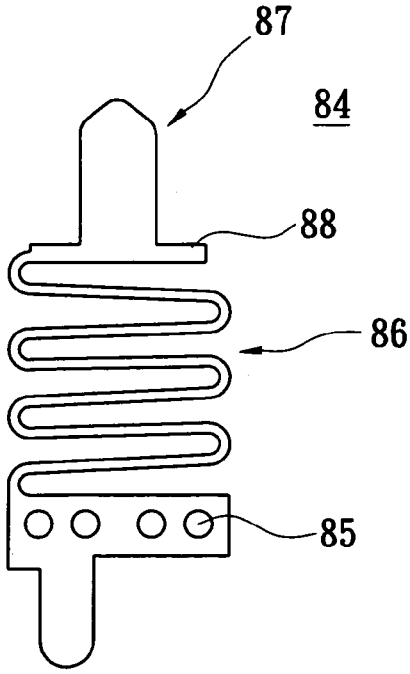
FIG. 2 PRIOR ART
FIG. 2 is a side view of an unfolded electrical-current biosensor of prior art.
Figure 3:
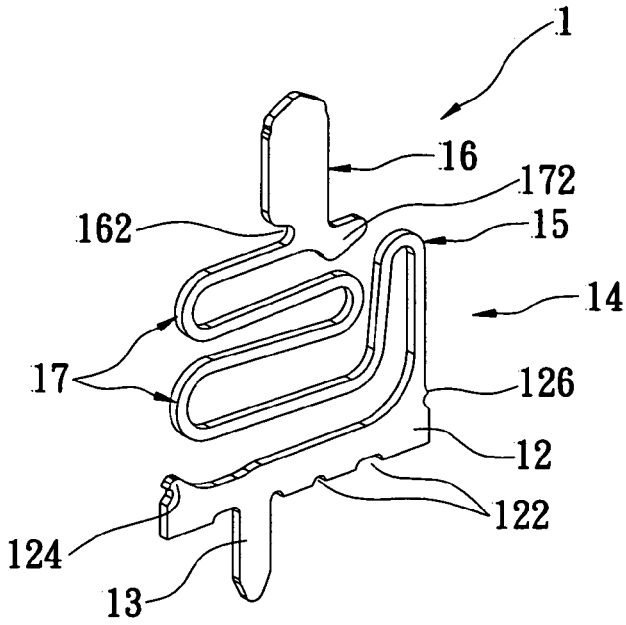
FIG. 3 is a top view of an unfolded electrical-current biosensor according to the present invention.
Figure 4:
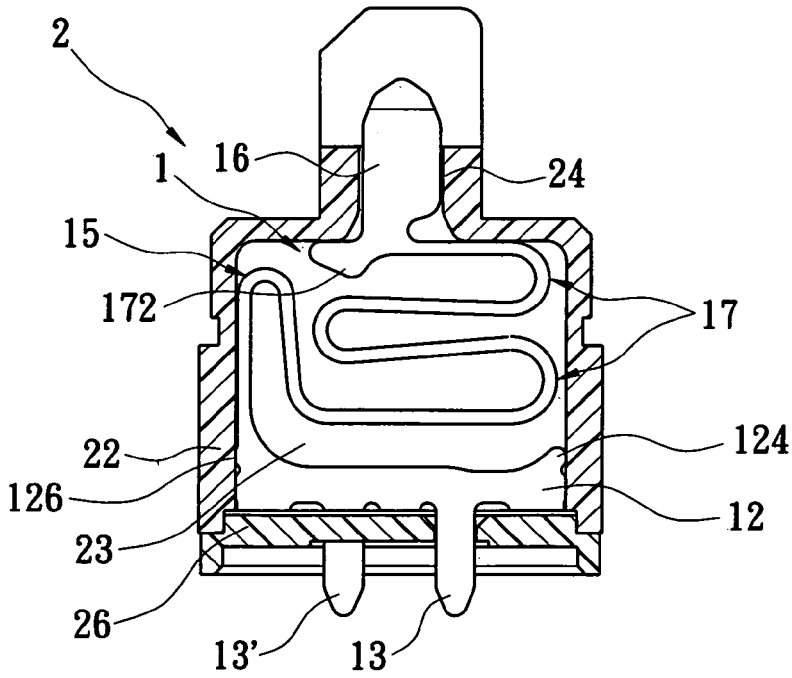
FIG. 4 is a side view of an unfolded electrical-current biosensor according to the present invention.

Referring to the FIGS. 3 and 4, a perspective view of an elastic terminal according to the present invention, and a cross-sectional view of the elastic terminal assembled in an electrical connector according to the present invention. An elastic terminal 1 of the prevent invention is received in an electrical connector 2 for electrically connecting with a mating connector 3 (referred to FIG. 5). The elastic terminal 1 has a retaining portion 12, an elastic arm 14, and a contact portion 16. The electrical connector 2 has an insulative housing 22 and a plurality of slots 24 which are formed on a top portion thereof. In this embodiment, the electrical connector 2 has further a PCB 26 which is disposed on a bottom thereof. The PCB 26 could be an insulative board for retaining the elastic terminal 1. The insulative housing 22 is formed with a receive cavity 23 for receiving the plurality of elastic terminals 1. The mating connector 3 has a plurality of mating terminals 32.

The retaining portion 12 has a soldering leg 13 which is extending downwardly and vertically from a bottom thereof to solder with the PCB 26. The soldering leg 13 is disposed at one side of the bottom of the retaining portion 12, not at the middle of the bottom, so that the plurality of the elastic terminals 1 can be soldered on the PCB 26 in a reverse and parallel way. The staggered arrangement of the soldering legs 13 is convenient for soldering, as the soldering leg 13' shown in FIG. 4. The soldering leg 13 can be soldered directly with a cable, not on the PCB 26.

In this embodiment, the retaining portion 12 is formed symmetrically with a plurality of notches 122 on a bottom edge thereof. The pair of notches 122 are formed on two sides of a root portion of the soldering leg 13, so that strengthening intensity of the root and providing various positions for the soldering leg. The retaining portion 12 has a free end, and the free end is protruded outwardly with a barb 124. A connecting portion of the retaining portion 12 and the elastic arm 14 is also protruded outwardly with a barb 126. The pair of barbs 124, 126 are benefited the elastic terminal 1 to produce interfering with the insulative housing 22 and be fixed in the receiving cavity 23.

The elastic arm 14 has a longitudinal curved portion 15 which is extending upwardly from one side of the retaining portion 12, and at least two transverse curved portions 17 which are formed on one side of the longitudinal curved portion 15. Therefore the elastic arm 14 of the present invention reacts on the mating connector 3 with multi-directional elastic forces. The longitudinal curved portion 15 provides a side elastic force. The two transverse curved portions 17 are connected to each other and provide a vertical elastic force.

The contact portion 16 is formed on an end of the elastic arm 14 and is exposed outside the slot 24 of the electrical connector 2.

Figure 5:
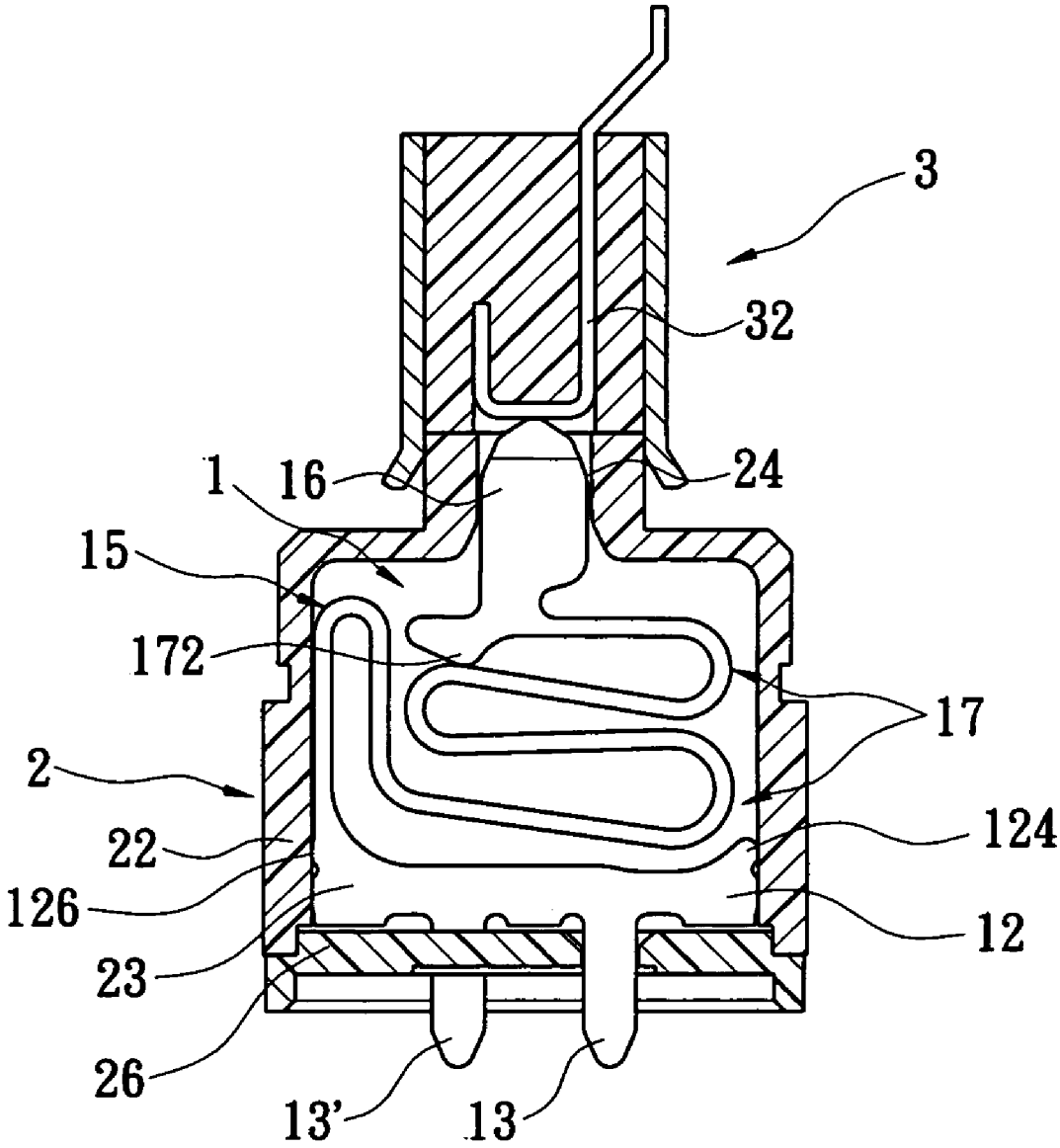
FIG. 5 is a top view of a folded electrical-current biosensor according to the present invention.

As shown in FIG. 5, illustrates a cross-sectional view of the elastic terminal which is assembled in an electrical connector, and the electrical connector is inserted into a mating connector. In the preferred embodiment, an end of the elastic arm 14 is protruded downwardly a leaned portion 172. When the contact portion 16 is pressed down, the leaned portion 172 is leaned against the transverse curved portions 17, so that produces a shorter signal transmitting path which is benefited quality of signal. In the preferred embodiment, the contact portion 16 is formed with a cutout 162 on a bottom end thereof, and is opposite to the end of the elastic arm 14. The contact portion 16 not only can maintain the original elasticity, but also reduce a downward pressure to the transverse curved portions 17, and therefore reducing deformation. The force reacts directly to the leaned portion 172. The contact portion 16 can also economize the material.

Via the mentioned structure above, the elastic terminal 1 of the present invention can disperse the pressed force from the mating connector 3 for reducing the fatigue of elasticity, and enhancing the contact reliability. Furthermore, by the bending form of the present invention, the length of the elastic arm 14 is shorter than that of the prior art, so that can decrease the resistance to enhance the quality of signals.

Figure 6:
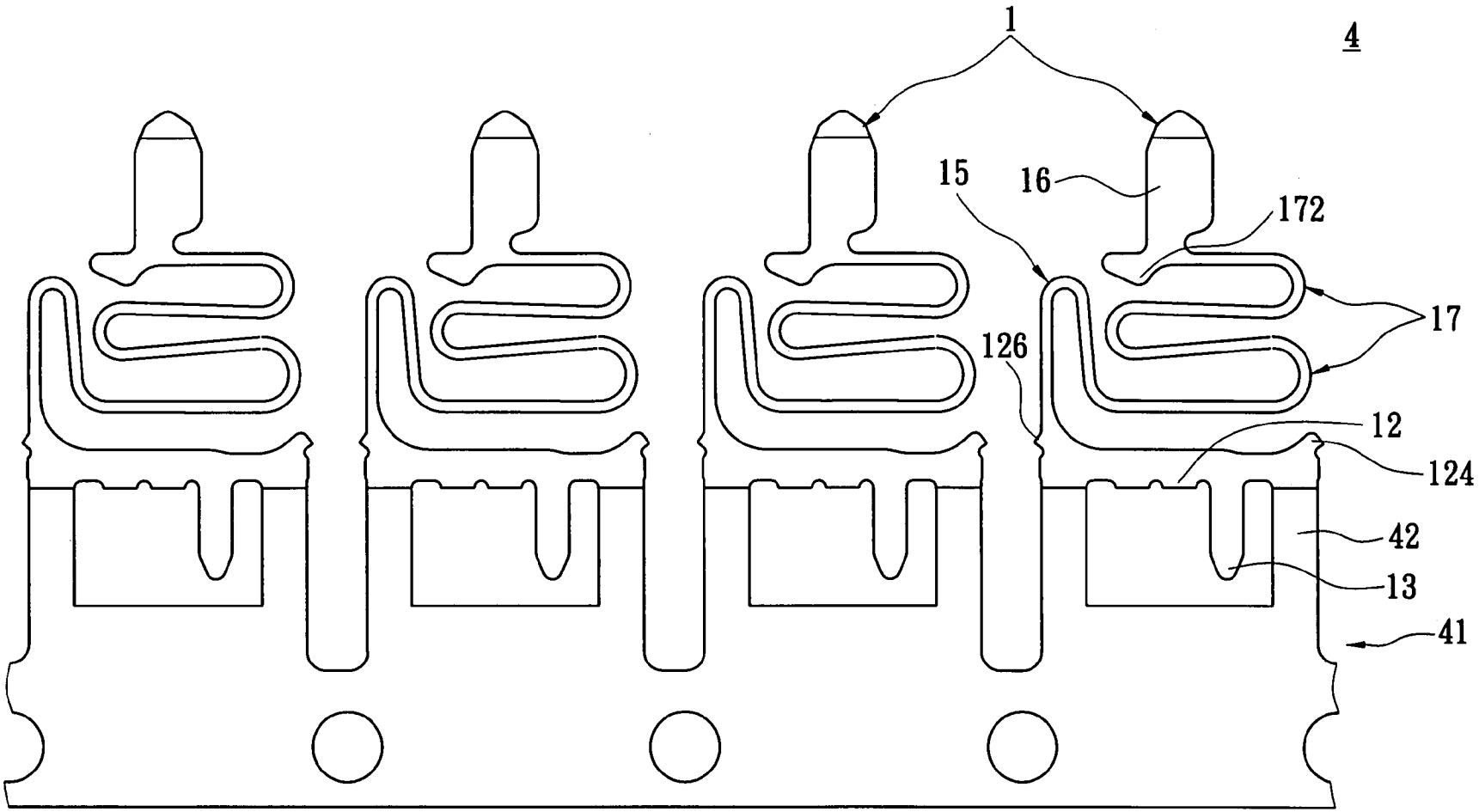
FIG. 6 is a side view of a folded electrical-current biosensor according to the present invention.

Referring to the FIG. 6, illustrates a front view of an elastic terminal belt according to the present invention. The elastic terminals 1 of the present invention are obtained by cutting an elastic terminal belt 4. The elastic terminal belt 4 is formed by punching a metal plate. After punched, the elastic terminal belt 4 has a metal bridge 41 and a plurality of linking piers 42 which are extended upwardly from the metal bridge 41, and the plurality of elastic terminals 1 are formed thereon. The retaining portion 12 of the elastic terminals 1 is connected with the linking pier 42. Because the bending form of the present invention provides stronger and multi-directional elastic forces, the present invention can use cheaper Cu-alloy which can achieve the same effect. It is obvious that can reduce manufacture cost.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An elastic terminal, received in an electrical connector for electrically connecting with a mating connector, comprising:

a retaining portion having a soldering leg extending downwardly and vertically therefrom;

an elastic arm extending upwardly from one side of the retaining portion continuously along a laterally asymmetric curvilinear path, the elastic arm having a lengthwise curved portion and at least two transverse curved portions laterally offset from one side of the lengthwise curved portion; and a contact portion formed on an end of the elastic arm and exposed outside the slot of the electrical connector.

2. The elastic terminal as in claim 1, wherein the retaining portion is formed with a plurality of notches on a bottom edge thereof.

3. The elastic terminal as in claim 1, wherein the retaining portion has a free end, and a barb protruded outwardly from the free end.

4. The elastic terminal as in claim 1, wherein a barb is protruded outwardly from a connecting portion of the retaining portion and the elastic arm.

5. The elastic terminal as in claim 1, wherein a leaned portion is protruded downwardly from an end of the elastic arm.

6. The elastic terminal as in claim 1, wherein a cutout is formed on a bottom end of the contact portion, and the cutout is opposite to an end of the elastic arm.

7. An electrical connector, comprising:

an insulative housing having a receive cavity formed therein and a plurality of slots formed on a top portion thereof; and a plurality of elastic terminals received in the receive cavity, each of the elastic terminals having a retaining portion, an elastic arm extending upwardly from the retaining portion continuously along a laterally asymmetric curvilinear path, and a contact portion formed on an end of the elastic arm; wherein the retaining portion has a soldering leg extending downwardly and vertically therefrom, the elastic arm having a lengthwise curved portion and at least two transverse curved portions laterally offset from one side of the lengthwise curved portion; wherein the contact portions are respectively exposed outside the slots of the insulative housing.

8. The electrical connector as in claim 7, wherein the retaining portion is formed with a plurality of notches on a bottom edge thereof.

9. The electrical connector as in claim 7, wherein the retaining portion has a free end, and a barb protruded outwardly from the free end.

10. The electrical connector as in claim 7, wherein a barb is protruded outwardly from a connecting portion of the retaining portion and the elastic arm.

11. The electrical connector as in claim 7, wherein a leaned portion is protruded downwardly from an end of the elastic arm.

12. The electrical connector as in claim 7, wherein a cutout is formed on a bottom end of the contact portion, and the cutout is opposite to an end of the elastic arm.

13. An elastic terminal belt, which is formed by punching a metal plate, comprising:

a metal bridge, having a plurality of linking piers extended upwardly therefrom;

a plurality of elastic terminals, each of the elastic terminals having a retaining portion, an elastic arm extending upwardly from the retaining portion continuously along a laterally asymmetric curvilinear path, and a contact portion formed on an end of the elastic arm; wherein the retaining portion has a soldering leg extending downwardly and vertically therefrom, wherein the elastic arm has a lengthwise curved portion extending upwardly from one side of the retaining portion, the elastic arm having a lengthwise curved portion and at least two transverse curved portions laterally offset from one side of the lengthwise curved portion; wherein the retaining portions are connected with the linking piers.

14. The elastic terminal belt as in claim 13, wherein the retaining portion is formed with a plurality of notches on a bottom edge thereof.

15. The elastic terminal belt as in claim 13, wherein the retaining portion has a free end, and a barb protruded outwardly from the free end.

16. The elastic terminal belt as in claim 13, wherein a barb is protruded outwardly from a connecting portion of the retaining portion and the elastic arm.

17. The elastic terminal belt as in claim 13, wherein a leaned portion is protruded downwardly from an end of the elastic arm.

18. The elastic terminal belt as in claim 13, wherein a cutout is formed on a bottom end of the contact portion, and the cutout is opposite to an end of the elastic arm.

* * * * *